US005657823A

United States Patent [19]

Kogure et al.

[11] Patent Number: 5,657,823

[45] Date of Patent: Aug. 19, 1997

[54] NEAR SURFACE DISCONNECT RISER

[76] Inventors: Eiji Kogure, 670 Ichinomiya, Tama-city, Tokyo, Japan; Michael J. Mackie, 17 Mayfair Grove Ct., The Woodlands, Tex. 77381; Jeffrey M. McCalla, 202 Faust La., Houston, Tex. 77024; Hiroichi Hayashi, 403-4 Idanakano, Mati, Nakahara-ku, Kawasaki-city, Kanagawa-prefecture, Japan

[21] Appl. No.: 556,609

[22] Filed: Nov. 13, 1995

[51] Int. Cl.[6] ..... E21B 17/01; E21B 17/06

[52] U.S. Cl. ..... 166/340; 166/345; 405/195.1

[58] Field of Search ..... 166/350, 338, 166/340, 345, 359, 367, 355, 339; 405/195.1

[56] References Cited

U.S. PATENT DOCUMENTS

| | | | |
|---|---|---|---|
| 3,554,277 | 1/1971 | Bauer et al. | 166/338 |
| 3,782,458 | 1/1974 | Slack . | |
| 3,913,668 | 10/1975 | Todd et al. | 166/359 |
| 4,046,191 | 9/1977 | Neath | 166/352 |
| 4,047,579 | 9/1977 | Wickens . | |
| 4,081,039 | 3/1978 | Wardlaw | 175/7 |
| 4,126,183 | 11/1978 | Walker | 166/338 |
| 4,188,156 | 2/1980 | Fisher . | |
| 4,194,568 | 3/1980 | Buresi . | |
| 4,234,047 | 11/1980 | Mott . | |
| 4,367,055 | 1/1983 | Gentry . | |
| 4,616,707 | 10/1986 | Langner | 166/345 |
| 4,646,840 | 3/1987 | Bartholomew . | |
| 4,662,785 | 5/1987 | Gibb et al. | 405/195.1 |
| 5,046,896 | 9/1991 | Cole | 405/195.1 |
| 5,421,676 | 6/1995 | Wyhro et al. | 405/223.1 |
| 5,439,321 | 8/1995 | Hunter . | |

OTHER PUBLICATIONS

"Composite Catalog", vol. 3, 1986–1987, pp. 4609, 4610, 4143–4145, World Oil.

*Primary Examiner*—Frank Tsay

*Attorney, Agent, or Firm*—Wendy Buskop; Cynthia G. Seal

[57] ABSTRACT

An offshore marine structure for drilling wells into the ocean floor including a floating vessel which carries the necessary drilling equipment. A riser which extends from the vessel to a well head at the ocean floor, encloses a drill string and permits circulation of the drilling mud and fluids. The riser is comprised of at least two detachably connectable segments, one of which can be moved with the floating vessel, while the other remains buoyantly in place until such time as the two segments are reconnected. A riser system used for production activities where the riser comprises at least two detachable segments is also provided.

27 Claims, 3 Drawing Sheets

NEAR SURFACE DISCONNECT RISER

BACKGROUND OF THE INVENTION

In the drilling of wells from a vessel at an offshore location it is necessary that a riser or elongated conductor extend from the vessel to the ocean floor, being normally connected to the well head structure. The function of the riser is to enclose the drill string and permit circulation of the drilling mud and drilling fluids during a drilling operation. Normally the riser comprises a series of pipe-like elements which are sealably joined into an elongated single conduit.

It can be appreciated that in the instance of relatively deep waters, the riser can be subjected to extreme stresses. This normally results from the action of water currents and the movement of the drilling vessel at the water's surface.

For example, such as during a Tsunami or hurricane the riser can be subjected to water currents in more than one direction. This action will induce a number of curves and stresses into the riser structure. The problem however can be minimized or even obviated by the use of suitable tensioning apparatus on the drilling vessel. Such apparatus functions to stress the riser to a predetermined degree so that the amount of physical deformation is minimized.

In relatively deep waters the necessary use of risers has imposed a number of problems which increase in intensity with water depth. However, where the waters are infested with hurricanes, storms, natural disasters, and the like, it can be appreciated that these stresses are greatly amplified on the riser.

For example, in waters subject to typhoons, it is necessary to quickly move the drilling or production vessel out of the area to be affected by the storm. The notice of such a storm is usually about 24 hours, leaving very little time to disconnect the drilling or production vessel and move it to a safe location. A drilling or production unit that can be quickly and easily removed from the riser would be highly desirable and cost effective.

Toward minimizing the time consumed to detach the vessel, and to minimize the expense of such a deep water drilling operation, the present invention provides a system wherein a drilling vessel is connected at the ocean floor by way of a disconnectable riser. The latter is provided with at least one remotely actuated connecting joint.

Functionally, the connecting joint is positioned in the riser structure approximately fifty to five-hundred feet (50'–500') below the water's surface in the instance of water depths in excess of about 1,000 feet. By uncoupling the riser at the joint, the upper segment can be displaced with the drill vessel while the lower segment remains substantially in place buoyed with a gas filled canister. The upper end of the detached segment is at a sufficient depth below the water's surface to be safe from damage as the storm passes.

It is therefore an object of the invention to provide an offshore well drilling and or production system capable of being rapidly disconnected from a drilling or production vessel such that the vessel can be removed quickly from the system. A further object is to provide such a system which is capable of permitting the riser member to be rapidly disconnected under emergency conditions at a point below the water's surface so that at least part of the riser will be displaced and the remainder held uprightly in place. A still further object is to provide a drill riser of the type contemplated which is adapted to be disconnected at such time as the drilling vessel is removed, and is further adapted to be readily reconnected at such time as the drilling vessel returns to recommence a drilling or production operation, either manually or by remote means.

SUMMARY

In the present invention there is provided, an offshore system for drilling well bores through a well head on an ocean floor. The system includes a drilling vessel floatably positioned at the water's surface and an elongated riser adapted to extend from the wellhead to the drilling vessel. The riser comprises a lower tubular segment comprising standard riser joints with an upper end and a lower end. The lower segment has a means for connecting to the subsea wellhead and a means for disconnectably engaging an upper tubular segment. The means for disconnectably engaging the upper segment further comprises a buoyancy system for suspending the lower segment above the ocean floor. The upper tubular segment has standard riser joints and a means for disconnectably engaging to the lower segment and to the drilling vessel.

A stress joint is positioned at the lower end of the lower segment. The stress joint is secured to a flex joint having greater flexibility than the stress joint. The stress joint has a main body part which is tubular, having a first section and a second section. The second section has a smaller cross sectional area whereby the main body has an increased flexibility at the second section as compared with the first section. The flex joint has a tubular main body with a flexible internal elastomeric lining which fits intimately and securely around the elongated riser system.

The system includes a means for passing a drilling string through said elongated riser to form said well bore in the ocean floor and a first blow-out prevention means connected to the wellhead.

The buoyancy system is positioned on said lower tubular segment to externally support said lower segment whereby to maintain the latter in a substantially upright position when said lower segment has been disengaged from the riser upper segment. A second blow-out prevention means is connected to the lower tubular segment of the riser.

In another embodiment of the invention there is provided an elongated riser adapted to extend from a subsea wellhead to a structure at the water's surface, such as a production facility. The riser comprises a lower tubular segment having an upper end and a lower end. The lower segment has a means for connecting to the subsea wellhead. The riser further comprises an upper tubular segment having a means for removably connecting to the lower segment and to the surface structure. A stress joint is positioned at the lower end of the lower segment. The stress joint is associated with a flex joint having greater flexibility than the stress joint. The stress joint has a main body pan which is cylindrical. The main body part has a lower section and an upper section and the upper section has a smaller cross sectional area whereby the main body has an increased flexibility at the upper section as compared with the lower section. The flex joint has a cylindrical main body having a lining comprising a flexible internal elastomeric material.

The upper tubular segment can be a flexible jumper attached to the means for removably connecting to the surface structure. The flexible jumper can be made of steel or composite materials.

DETAILED DESCRIPTION OF THE PREFERRED EMBODIMENTS

Figure 1:
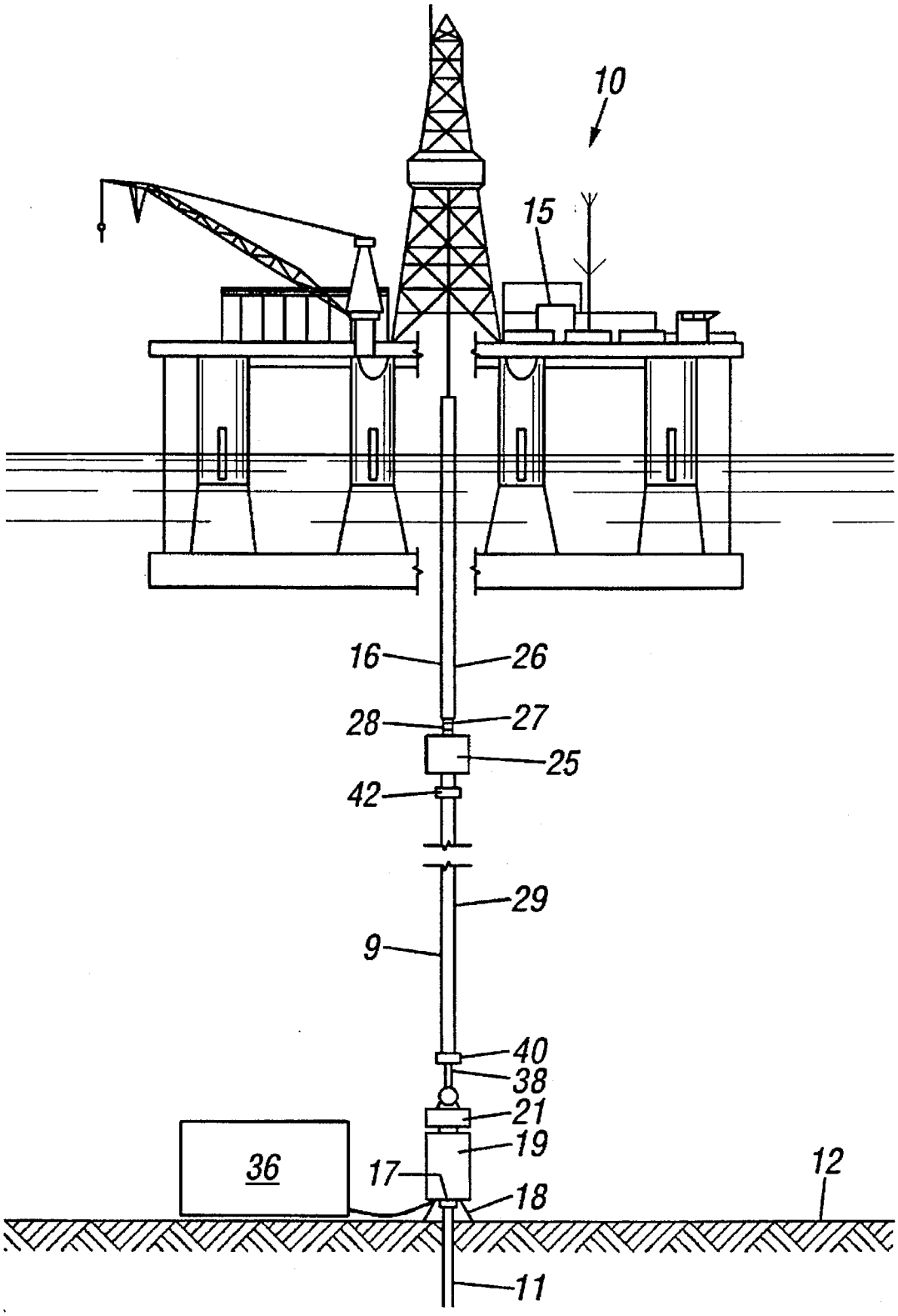
FIG. 1 is a pictorial view of the drilling vessel and the riser.
Figure 2:
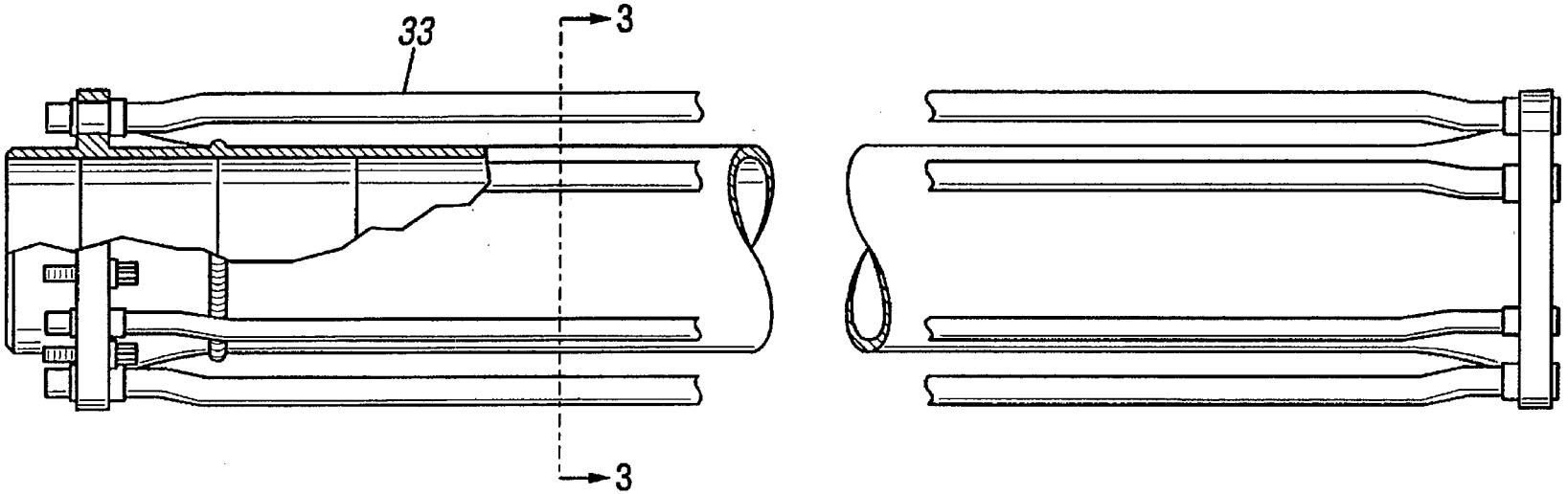
FIG. 2 a cut away view of a riser segment.

Referring to FIG. 1, a system of the type contemplated is shown in which a drilling vessel 10 is positioned at the water's surface and is adapted to drill a well bore into the floor 12 of the ocean. The floating vessel 10 is dynamically positioned.

Vessel 10 supports an elongated riser member 16. Riser member 16 is operably connected to the drilling vessel and extends downwardly in a substantially vertical disposition to be firmly connected to the top of the well head 17 at the ocean floor 12.

The drilling vessel 10 presently disclosed can be any one of a type normally in use as above noted for drilling offshore wells. The vessel shown is of the semisubmersible type, adapted for use in deep waters. However, other types of vessels, such as drill ships, or production vessels may also be used with the suggested riser system.

Riser stabilizing systems can be used to compensate for any movement of vessel 10. The stabilizer's action will thus neutralize the condition of the riser and/or the drill string without imposing undue strain on either member.

Submerged well head 17 is presently shown as comprising a base or foundation 18 which is fastened into the ocean floor by piles or mass anchors. Foundation 18 supports the necessary equipment usually carried at the ocean floor to accommodate a well drilling operation. Such equipment comprises primarily sufficient valving to regulate the drilling operation, together with a blowout prevention assembly 19 to facilitate the operation. In either instance, the lower end of elongated riser 16 will firmly engage the blowout prevention 19 whereby to permit a seal therebetween to facilitate the flow of drilling fluids.

Figure 3:
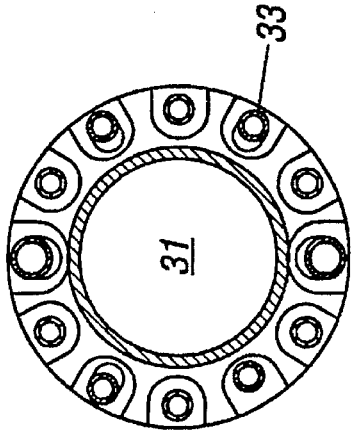
FIG. 3 is a cross-section along the lines 3—3.
Figure 4:
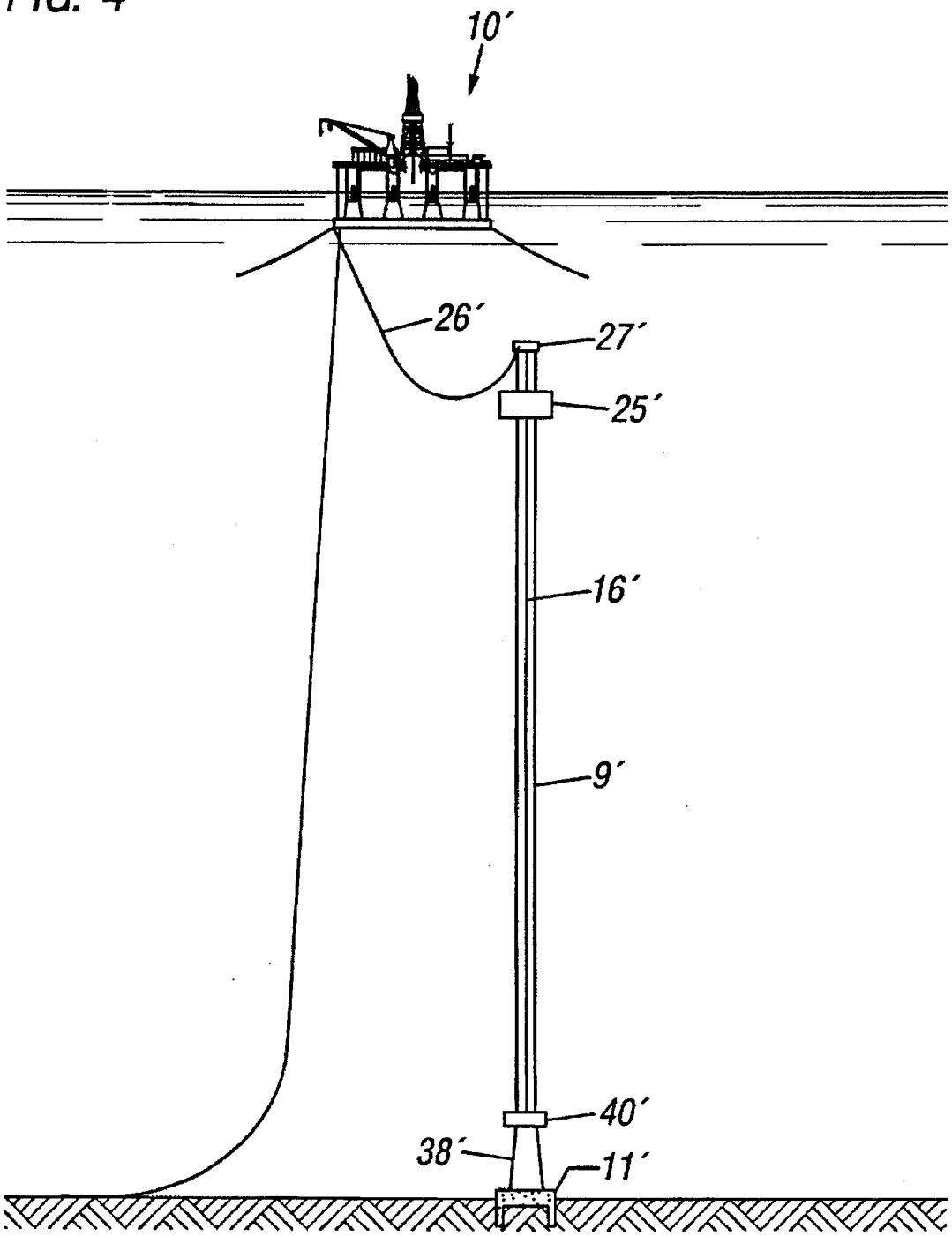
FIG. 4 is a pictorial view of a production facility using a riser

Riser 16 as shown, is fixed at its lower end to the blowout prevention 19 and at its upper end to the vessel 10. The blowout prevention 16 is operably fixed to a lower marine riser package 21 which is operably connected to a stress joint 23. Stress joint 23 is connected to standard riser joints 29 which are operably connected using a disconnectably engaging means 27 which can connect and disconnect to drilling vessel 10. Structurally, riser 16 comprises a series of discrete, end connected tubular members 33. The tubular member 33 can have an outer diameter between 30 and 50 inches. Physically, the discrete members are sequentially put together on the deck of the vessel and gradually lowered to well head 17. When completed, riser 16 in effect defines an elongated continuous passage or conduit which extends between drilling vessel 10 and the well bore 11. The tubular member 33 comprises an inner conduit 31 shown in FIG. 3, and a series of pipes for carrying hydraulic fluid, drilling mud, electrical cables, fiber optic cables, choke lines, booster lines, and kill lines.

Operationally, riser 16 functions to conduct drilling mud which has been pumped from a mud pump 15 down the drill string, not shown, into the borehole 11, back up to the vessel 10. This of course is a procedure normally followed in any offshore well drilling system.

Riser 16 when assembled, is comprised of at least two distinct elements; upper segment 26 and lower segment 9. Said segments are disconnectably engaged at a coupling joint 28 normally located 50 to 500 feet below the water's surface. Generally, joint 28 is located at a depth at which it is determined that the upper end of the lower riser segment 9 will be clear of any turbulence caused by weather conditions. The disconnectably engaging means 27 can disconnect or connect by remote actuating means which can bring the engaging end of the respective tubular segments into connection together.

There are a number of such pipe or conduit connectors, which are well known and used in the industry. Further, the connectors may be are usually guidably brought into engagement through the use of guide cables or the like or through the efforts of remotely operated vehicles, such as mini subs with camera apparatus.

Functionally, the actuation system operates in response to an acoustic signal originating from a vessel 10. An electronic signal is then transmitted upwardly to be received on the vessel 10 by suitable instrumentation whereby the vessel 10 can be displaced or adjusted to permit accurate aliment of the riser segments 26 and 9.

A further characteristic of riser member 16 is that it is normally so structured with hollow walls or with other means of buoyancy that it is at least partially buoyant.

In order to compensate for the upward pull exerted by the drilling vessel 10 at the time the upper segment 26 is displaced from the lower segment 9, the lower segment 9 of the riser can be provided with provisional, supplementary buoyant means. The latter is actuated or properly positioned only at such time as it is required.

In one embodiment, the supplementary buoyancy means can comprise a series of tanks 25 fixedly positioned to the upper end of the riser 16. The tanks 25 are optionally communicated with the water's surface whereby buoyancy of the tank or tanks can be easily controlled through pumping in air or other inert gasses from the vessel 10. As shown, tanks 25 can be rigid walled members which are permanently fixed to the lower tubular segment 9 of the riser 16 upper end and fixed thereabout. Further, when this option is used, each tank is communicated with vessel 10 by a valved conduit. Although not presently shown, such conduits for underwater use are well known in the art. The conduit is further communicated with a source of air or compressed gas at the water's surface. The air is normally precompressed in tanks, or compressed directly in a compressor and delivered to the underwater tank 25. Such ballasting and deballasting systems and equipment have long been in use in underwater operations such as diving and the like. The respective tank 25 can then be ballasted as needed, or evacuated to exert a maximum upward pull on lower riser segment 9 during a disconnect operation.

It is appreciated that to be able to initially run the riser 16 without adding weight the unit must be at least slightly negatively buoyant. Usually the flotation material is provided in the riser 16 structure to provide 95% to 98% buoyancy for the foam. The syntactic foam density of the buoyancy system can be changed to provide 98% buoyancy at any water depths, compensating for changing hydrostatic pressure. The air canisters which provide stability for the entire riser there is 98–100% buoyancy plus a level of tension for the entire riser system. After running the riser 16 the shipboard tensioners are applied to maintain inner tension.

When on the other hand upper riser senent 26 becomes disconnected from the lower riser segment 9 and vessel 10 is moved off location, it is first necessary to make the riser 16 buoyant by deballasting tanks 25. When rigid wall tanks are utilized, these can be similarly filled with air and pressurized to increase their buoyant capabilities.

To regulate the weight of the riser 16 a first valve is located at the top of the lower riser segment 9 adjacent to the disconnection point 27. A remotely operated valve near the bottom of the lower riser segment 9 and communicated with the interior thereof, can be opened to allow mud to drain from the riser 16 into a retaining vessel 36, and allowing the riser 16 to equalize to the exterior water pressure. Once the drilling or production vessel returns and is reconnected to the lower riser segment 9, the drill mud can then be pumped back up to the first valve and into the riser 16 so that operations may be resumed. A regulating means for controlling the mount of drilling fluid which is retained in the upper and lower tubular segments 26 and 9 respectively during a disconnect of the upper and lower segments and for preventing spillage of the drilling fluid into the ocean is provided. A means for conveying drilling fluid away from the lower segment 9 for containerization and further regulating the flow of the drilling fluid from the tubular segments and a means for retaining 36 dispensed drilling fluid away from the riser are also provided.

To minimize stress on the free standing lower riser segment 9, means is provided for rapidly evacuating or draining mud from the riser lower segment 9. The lower segment 9 is thus provided with a valved conduit means which is communicated with and which extends from the riser lower end. An internal pressure monitor associated with the valved conduit means actuates the opening and closing of this valve based on the external water pressure. When a valve is actuated to the open position, mud or other heavy drilling fluid is drained at a controllable rate into the retaining vessel 36. Concurrently, water will enter the upper end of the lower segment 9. The overall result will be that the integrity of the lower riser segment 9 is sustained, and its center of gravity is moved toward the bottom of the column.

The drilling fluid or mud can then be recycled to refill the lower riser segment 9. The expense is readily justified if the vessel 10 and the lower segment 9 are preserved and can be readily united to continue a drilling operation. Use of the retaining vessel 36 will reduce the mount of drilling fluid and or drilling mud released into the ocean.

The elongated riser 16 comprises a lower tubular segment 9 comprising standard riser joints and an upper end and a lower end. The lower segment 9 can be made of steel or other composite materials. The lower segment 9 has a means for connecting to the subsea wellhead and a means for disconnectably engaging 27 an upper tubular segment 26. The means for disconnectalby engaging 27 the upper segment can comprise a buoyancy system for suspending the lower segment 9 above the ocean floor 12. The upper tubular segment 26 comprises standard riser joints and a means for disconnectably engaging to the lower segment 27 and to the drilling vessel. A stress joint 38 is positioned at the lower end of the lower segment 9. The stress joint 38 is secured to a flex joint 40 having greater flexibility than the stress joint 38. The means for disconnectably engaging 27 may comprise retractable wet-matable electrical fiber optic connectors that provide a telemetry path from the upper segment 26 to the lower segment 9. The means for disconnectably engaging can be actuated by an acoustic signal. The upper tubular segment 26 may also have a flex joint and a stress joint similar to those described below.

The stress joint 38 has a main body part which is tubular and a first section and a second section. The second section has a smaller cross sectional area whereby the main body has an increased flexibility at the second section as compared with the first section. The main body of the stress joint 38 is between about 10 and about 80 feet in length. The second section of the stress joint 38 consists of a member of the group comprising steel, titanium, composite material and a combination of these materials, and the stress joint 38 being capable of having at least an equivalent minimum yield strength of about 45,000 psi to about 120,000 psi, preferably 70,000 psi.

The flex joint 40 has a tubular main body and a flexible internal elastomeric lining which fits intimately and securely around the elongated riser 16. The flex joint 40 has a rotational stiffness of between 2 kNm/degree and 200 kNm/degree. The flexible elastomeric lining of the flex joint 40 comprises a member of the group consisting of rubber, urethane, flouroelastomers, fluorocarbons, polysiloxanes, polyisoprene, butadiene, styrene-butadiene, acrylonitrile butadiene, polychloroprene, isobutylene-isoprene, and mixtures of rubber and composites, and mixtures thereof.

The buoyancy system is positioned on the lower tubular segment 9 to externally support the lower segment 9 whereby to maintain the latter in a substantially upright position when the lower segment 9 has been disengaged from the upper riser segment 26. The buoyancy system can comprise a canister filled with a gas selected from the group of pressurized gas, air, nitrogen, and helium and mixtures thereof.

A second blowout prevention means 42 is connected to the lower tubular segment of the riser. The second blowout prevention means 42 can be positioned between the buoyancy system and the wellhead and adjacent to the means for disconnectably engaging the upper segment. The second blowout prevention means 42 can be disposed adjacent the buoyancy system and positioned between the disconnectably engaging means 27 and the buoyancy system. Alternatively, the second blowout prevention means 42 can be disposed adjacent the buoyancy system and positioned between the buoyancy system and the well head on the ocean floor 12.

In another embodiment of the invention there is provided an elongated riser 16' adapted to extend from a subsea production facility to a structure at the water's surface 10', such as an above sea production facility. The riser 16' may contain production tubing or the like disposed within the riser 16' for extracting oil and gas from the well. The riser 16' comprises a lower tubular segment 9' having an upper end and a lower end. The lower segment 9' has a means for connecting to the subsea production facility. The riser 16' can comprise an upper tubular segment having a means for disconnectably engaging the lower segment 9' and to the structure at the water's surface. The means for disconnectably engaging can have retractable wet-matable electrical fiber optic connectors that provide a telemetry path from the upper segment to the lower segment 9' and can be actuated by an acoustic signal. A stress joint 38' is positioned at the lower end of the lower segment 9'. The stress joint 38' is associated with a flex joint 40' having greater flexibility than the stress joint 38'. Preferably, there is a buoyancy system as described previously with a canister filled with a gas selected from the group of pressurized gas, air, nitrogen, and helium and mixtures thereof.

The stress joint 38' has a main body part which is cylindrical. The main body part has a lower section and an upper section and the upper section has a smaller cross sectional area whereby the main body has an increased flexibility at the upper section as compared with the lower section. The main body of the stress joint 38' is between about 10 and about 80 feet in length. The second section of the stress joint 38' consists of a member of the group comprising steel, titanium, composite material and a combination of these materials, and the stress joint 38' being capable of having at least a minimum yield strength of about 45,000 psi to about 120,000 psi, preferably about 70,000 psi.

The flex joint 40' has a cylindrical main body with a lining comprising a flexible internal elastomeric material. The flex joint 40' has a rotational stiffness of between 2 kNm/degree and 200 kNm/degree. The flexible elastomeric lining of the flex joint 40' comprises a member of the group consisting of rubber, urethane, flouroelastomers, fluorocarbons, polysiloxanes, polyisoprene, butadiene, styrenebutadiene, acrylonitrile butadiene, polychloroprene, isobutylene-isoprene, and mixtures of rubber and composites, and mixtures thereof. Alternatively, the second end of the lower tubular segment 9 may have a flex joint and a stress joint as described previously.

The upper tubular segment 26' can be a flexible jumper attached to the means for removably connecting to the surface structure. The flexible jumper can be made of steel or composite materials.

Other modifications and variations of the invention as hereinbefore set forth can be made without departing from the spirit and scope thereof, and therefore, only such limitations should be imposed as are indicated in the appended claims.

We claim:

1. An offshore system for drilling well bores through a well head on an ocean floor which includes:

a drilling vessel floatably positioned at the water's surface;

an elongated riser adapted to extend from the wellhead to the drilling vessel comprising:

a lower tubular segment comprising standard riser joints and having an upper end and a lower end, said lower segment having means for connecting to the subsea wellhead and a means for disconnectably engaging an upper tubular segment, wherein said means for disconnectably engaging the upper segment further comprises a buoyancy system for suspending the lower segment above the ocean floor;

said upper tubular segment comprising standard riser joints and means for disconnectably engaging to the lower segment and to the drilling vessel;

a stress joint positioned at said lower end of the lower segment, said stress joint being secured to a flex joint having greater flexibility than the stress joint;

said stress joint having a main body part which is tubular, having a first section and a second section, said second section having a smaller cross sectional area whereby the main body has an increased flexibility at the second section as compared with the first section;

said flex joint having a tubular main body and further comprising a flexible internal elastomeric lining which fits intimately and securely around the elongated riser;

a means for passing a drilling string through said elongated riser to form said well bore in the ocean floor;

a first blow-out prevention means connected to the wellhead;

said buoyancy system positioned on said lower tubular segment to externally support said lower segment whereby to maintain the latter in a substantially upright position when said lower segment has been disengaged from the riser upper segment; and a second blow-out prevention means connected to said lower tubular segment of the riser.

2. The system of claim 1, wherein said flex joint has a rotational stiffness of between 2 kNm/degree and 200 kNm/degree.

3. The system of claim 1, wherein the main body of the stress joint is between about 10 and about 80 feet in length.

4. The system of claim 1, wherein said second section of said stress joint consists of a member of the group comprising steel, titanium, composite material and a combination of these materials, and said stress joint being capable of having at least an equivalent minimum yield strength of about 45,000 psi to about 120,000 psi.

5. The system of claim 4, wherein said equivalent minimum yield strength is about 70,000 psi.

6. The system of claim 1, wherein said flexible elastomeric lining of said flex joint comprises a member of the group consisting of rubber, urethane, flouroelastomers, fluorocarbons, polysiloxanes, polyisoprene, butadiene, styrene-butadiene, acrylonitrile butadiene, polychloroprene, isobutylene-isoprene, and mixtures of rubber and composites, and mixtures thereof.

7. The system of claim 1 wherein the lower tubular segment comprises steel tubing.

8. The system of claim 1, wherein the second blow-out prevention means is positioned between the buoyancy system and the wellhead and adjacent to the means for disconnectably engaging the upper segment.

9. The system of claim 1, wherein the buoyancy system further comprises a canister filled with a gas selected from the group of pressurized gas, air, nitrogen, and helium and mixtures thereof.

10. The system of claim 1, wherein the means for disconnectably engaging further comprises retractable wet-matable electrical fiber optic connectors that provide a telemetry path from the upper segment to the lower segment.

11. The system of claim 1, wherein the upper tubular segment further comprises a flex joint and a stress joint.

12. The system of claim 10, wherein the means for disconnectably engaging is actuated by an acoustic signal.

13. The system of claim 1, wherein the second blowout prevention means is disposed adjacent said buoyancy system and positioned between said disconnectably engaging means and the buoyancy system.

14. The system of claim 1, wherein the second blowout prevention means is disposed adjacent said buoyancy system and positioned between the buoyancy system and the well head on the ocean floor.

15. The system of claim 1, having a regulating means for controlling the amount of drilling fluid which is retained in the upper and lower tubular segments respectively during a disconnect of said upper and lower segments and for preventing spillage of said drilling fluid into the ocean;

a means for conveying drilling fluid away from the lower segment for containerization and further regulating the flow of the drilling fluid from said tubular segments; and a means for retaining dispensed drilling fluid away from the riser.

16. An elongated riser adapted to extend from a subsea production facility to a structure at the water surface comprising;

a lower tubular segment having an upper end and a lower end, said lower segment having means for connecting to the subsea production facility;

an upper tubular segment having means for removably connecting to the lower segment and to the structure at the water's surface;

a stress joint positioned at the lower end of the lower segment, said stress joint being associated with a flex joint having greater flexibility than the stress joint;

said stress joint having a main body part which is cylindrical, having a first section and an second section, said second section having a smaller cross sectional area whereby the main body has an increased flexibility at the second section as compared with the first section;

said flex joint having a cylindrical main body having a lining comprising a flexible internal elastomeric material.

17. The riser of claim 16, wherein said flex joint has a rotational stiffness of between 2 kNm/degree and 200 kNm/degree.

18. The riser of claim 16, wherein the main body of the stress joint is between about 10 and about 80 feet in length.

19. The riser of claim 16, wherein said second section of the stress joint consists of a member of the group comprising steel, titanium, composite material and a combination of these materials, and said stress joint being capable of having at least a minimum yield strength of about 45,000 psi to about 120,000 psi.

20. The riser of claim 19, wherein said minimum yield strength is about 80,000 psi.

21. The riser of claim 16, wherein said flexible elastomeric lining of the flex joint comprises a member of the group consisting of rubber, urethane, flouroelastomers, fluorocarbons, polysiloxanes, polyisoprene, butadiene, styrene-butadiene, acrylonitrile butadiene, polychloroprene, isobutylene-isoprene, and mixtures of rubber and composites, and mixtures thereof.

22. The riser of claim 16 wherein the lower tubular segment comprises steel tubing.

23. The riser of claim 16, wherein further comprising a buoyancy system comprising a canister filled with a gas selected from the group of pressurized gas, air, nitrogen, and helium and mixtures thereof.

24. The riser of claim 16, wherein the means for disconnectably engaging further comprises retractable wet-matable electrical fiber optic connectors that provide a telemetry path from the upper segment to the lower segment.

25. The riser of claim 16, wherein the second end of the lower tubular segment further comprises a flex joint and a stress joint.

26. The riser of claim 24, wherein the means for disconnectably engaging is actuated by an acoustic signal.

27. The riser of claim 16, wherein the upper segment comprises a flexible jumper.

* * * * *